US008955433B2

(12) United States Patent
Peterson et al.

(10) Patent No.: US 8,955,433 B2
(45) **Date of Patent: *Feb. 17, 2015**

(54) METHOD AND SYSTEM FOR PAD PRINTING WITH REMOVABLE PRE-FILLED INK CUP

(75) Inventors: Samuel Peterson, Sycamore, IL (US); Christopher Schaafsma, Wheaton, IL (US); Sigi Knappik, Schaumburg, IL (US); Christopher Williamson, Winfield, IL (US)

(73) Assignee: Illinois Tool Works Inc., Glenview, IL (US)

( * ) Notice: Subject to any disclaimer, the term of this patent is extended or adjusted under 35 U.S.C. 154(b) by 302 days.

This patent is subject to a terminal disclaimer.

(21) Appl. No.: 13/434,402

(22) Filed: Mar. 29, 2012

(65) Prior Publication Data

US 2012/0180677 A1 Jul. 19, 2012

Related U.S. Application Data

(63) Continuation-in-part of application No. 11/929,042, filed on Oct. 30, 2007.

(60) Provisional application No. 60/867,991, filed on Nov. 30, 2006.

(51) Int. Cl.
*B41F 17/00* (2006.01)
*B41F 9/10* (2006.01)
*B41F 31/02* (2006.01)

(52) U.S. Cl.
CPC ..... *B41F 17/001* (2013.01)
USPC ..... 101/163; 101/169

(58) Field of Classification Search
CPC ..... B41F 17/001; B41F 9/061; B41F 9/08; B41F 9/10; B41F 9/1009; B41F 31/02; B41P 2200/31; B41P 2231/00
USPC ..... 101/163, 169, 170, 41
IPC ..... B41F 17/34,9/08, 9/10, 31/02
See application file for complete search history.

(56) References Cited

U.S. PATENT DOCUMENTS 4,393,775 A 7/1983 Cappel et al.
4,432,282 A 2/1984 Jurinak
(Continued)

FOREIGN PATENT DOCUMENTS

CA 2299759 A1 9/2001
DE 2205430 A1 2/1971
(Continued)

OTHER PUBLICATIONS

Partial English language translation of DE 196 44 366 A1, publication date Apr. 30, 1998.*
(Continued)

*Primary Examiner* — Leslie J Evanisko
(74) *Attorney, Agent, or Firm* — Christopher R. Carroll; The Small Patent Law Group LLC

(57) ABSTRACT

A doctor assembly for a pad printing system includes a body and a doctor blade. The body has an outer surface and an opposite inner surface that defines a passageway through the body. The inner surface engages a removable pre-filled ink cup to secure the ink cup to the body. The inner surface directs ink from the ink cup through the passageway toward an ink-receiving surface of a cliché device. The doctor blade is coupled with the body and engages the cliché device. The doctor blade wipes the ink along the cliché device as the body laterally moves relative to the cliché device. The doctor blade is coupled with the body such that the doctor blade is laterally spaced apart from the inner surface of the body.

19 Claims, 7 Drawing Sheets

(56) References Cited

U.S. PATENT DOCUMENTS

| | | | | |
|---|---|---|---|---|
| 4,557,195 | A | 12/1985 | Phlipp | |
| 4,905,594 | A | 3/1990 | Phillip et al. | |
| 5,003,872 | A | 4/1991 | Dalferth | |
| 5,272,972 | A | 12/1993 | Tobita | |
| 5,320,037 | A | 6/1994 | Harris | |
| 5,392,706 | A | 2/1995 | Drew, II et al. | |
| 5,476,040 | A | 12/1995 | Kleist | |
| 5,577,442 | A | 11/1996 | Tanaka et al. | |
| 5,746,129 | A | 5/1998 | Murray | |
| 6,626,100 | B2 * | 9/2003 | Adner | 101/163 |
| 2002/0152903 | A1 | 10/2002 | Adner | |
| 2005/0174398 | A1 | 8/2005 | Hessert et al. | |
| 2008/0127845 | A1 | 6/2008 | Knappik et al. | |

FOREIGN PATENT DOCUMENTS

| | | | |
|---|---|---|---|
| DE | 2011228 | A1 | 10/1971 |
| DE | 9006932 | | 8/1990 |
| DE | 19644366 | A1 * | 4/1998 |
| EP | 0736380 | | 10/1996 |
| EP | 1033246 | | 9/2000 |
| JP | 10109403 | A * | 4/1998 |
| JP | 2006281721 | A * | 10/2006 |
| WO | WO91/17888 | | 11/1991 |
| WO | WO2008/067171 | | 6/2008 |

OTHER PUBLICATIONS

ISR and WO for PCT/US2013/034233 dated Aug. 22, 2013 (12 pgs.).
English Machine Translation of WO 91/17888 A1, Nov. 1991, Bernd Berberich.

* cited by examiner

METHOD AND SYSTEM FOR PAD PRINTING WITH REMOVABLE PRE-FILLED INK CUP

CROSS-REFERENCE TO RELATED APPLICATIONS

This application is a continuation-in-part of U.S. patent application Ser. No. 11/929,042, which was filed Oct. 30, 2007 (the "'042 application), which claims priority to and the benefit of U.S. Provisional Patent Application 60/867,991, which was filed on Nov. 30, 2006 (the "'991 application). The entire disclosures of the '042 application and the '991 Application are incorporated herein by reference.

TECHNICAL FIELD

The presently described inventive subject matter relates generally to printing, such as pad printing.

BACKGROUND

Pad printing can be used to apply an image to a product. Pad printing may be used in applications for applying images to rounded (e.g., three dimensional) products, such as syringes and sporting equipment. Pad printing is also effective on uneven surfaces, such as the dimpled surface of a golf ball.

Some known pad printing systems use a deformable pad that receives ink, transferred as an image, from a flat cliché plate. The plate has an engraving or etching of the image formed in the plate. The etching of the cliché plate results in recesses in a surface of the cliché plate for receiving or containing ink. The ink is transferred from a liquid supply assembly to the cliché plate where the ink fills the etched recesses. The deformable pad is then pressed onto the plate and ink within the etched recesses is picked up by the pad. The image is then transferred to the print surface by pressing the deformable pad onto the print surface.

To re-ink the pad, an inverted cup that contains a quantity of printing ink may be used to apply additional ink to the cliché plate. The cup and cliché plate are translated relative to each other such that a coating of ink is deposited from the cup onto the cliché plate as the portion of the cliché plate bearing the etched image or indicia travels adjacent (e.g., below) the inverted cup. A doctor blade is fitted to the cup to traverse along the cliché plate and wipe excess ink from the cliché plate. The action of the doctor blade leaves behind the ink that fills the recesses in the etched area of the cliché plate while removing other ink from areas that do not form part of the image (e.g., the ink disposed outside of the etched recesses on the cliché plate) and where the ink may tend to buildup if not removed.

Conventionally, ink is poured from a shipping container, in which the ink was purchased, into a mixing container for mixing of the ink with a quantity of a thinner. The ink is transferred from the mixing container to the ink cup of the pad printing system and the mixing container is discarded. When the ink in the ink cup is depleted, the ink cup is cleaned and refilled. Cleaning of the cup can be costly in terms of the time, labor, and materials required to perform the operation. Additionally, cleaning the cup can involve the handling of potentially noxious substances. Furthermore, the ink that remains in the mixing container is lost, since the remaining ink may be discarded along with the mixing container. Ink also may be potentially lost when the ink is transferred from the mixing container to the cup due to the risk of spillage.

In some known pad printing systems, the ink that is contained within the doctor blade may be insufficient to completely cover the recesses in the etched area. For example, the ink that is moved over the etched area by the doctor blade may not flow into all of the recesses. As a result, not all of the recesses may receive ink and at least a portion of the image to be formed by the recesses may not be formed on the object that receives the ink.

It is desirable to provide a method and system for pad printing that would overcome one or more of the aforementioned and/or other disadvantages.

BRIEF DESCRIPTION

One embodiment of the inventive subject matter described herein provides a method for operating a pad printing system. The method includes receiving a removable pre-filled ink cup on a doctor assembly, orienting the removable pre-filled ink filled cup on the doctor assembly, and dispensing ink from the oriented removable pre-filled ink cup.

In another embodiment, a system for operating a pad printing system includes means for receiving a removable pre-filled ink cup on a doctor assembly, means for orienting the removable pre-filled ink cup on the doctor assembly, and means for dispensing ink from the oriented removable pre-filled ink cup.

In another embodiment, a pad printing system including a doctor assembly that includes a removable pre-filled ink cup receiving portion. The receiving portion provides orientation of removable pre-filled ink cups.

In another embodiment, another aspect of the inventive subject matter described herein provides a removable pre-filled ink cup for a pad printing system. The ink cup includes an ink retention portion pre-filled with ink and a doctor assembly orientation portion formed on an outer portion of the retention portion. The removable pre-filled ink cup is configured to deposit ink on a cliché device via a doctor assembly that is mated with the doctor assembly orientation portion.

In another embodiment, another doctor assembly for a pad printing system includes a body and a doctor blade. The body has an outer surface and an opposite inner surface that defines a passageway through the body. The inner surface is configured to engage a removable pre-filled ink cup to secure the ink cup to the body. The inner surface also is configured to direct ink from the ink cup through the passageway toward an ink-receiving surface of a cliché device of the pad printing system. The doctor blade is configured to be coupled with the body and to engage the cliché device. The doctor blade is configured to wipe at least some of the ink along the cliché device as at least one of the body or the cliché device laterally moves relative to another of the at least one of the body or the cliché device. The doctor blade is configured to be coupled with the body such that the doctor blade is laterally spaced apart from the inner surface of the body.

In another embodiment, a doctor assembly for a pad printing system has a body that includes an inner surface and a lower surface. The inner surface is configured to engage a removable pre-filled ink cup to secure the ink cup. The inner surface includes an interior wall and defines a passageway that directs ink from the ink cup toward an ink-receiving surface of a cliché device of the pad printing system. The lower surface intersects the inner surface. The lower surface is configured to couple with a doctor blade that engages the ink-receiving surface of the cliché device and wipes at least some of the ink from the ink cup along the ink-receiving surface of the cliché device as the doctor assembly laterally moves along the ink-receiving surface of the cliché device. The interior wall of the inner surface is oriented at an acute angle with respect to the lower surface.

In another embodiment, another doctor assembly for a pad printing system is provided. The doctor assembly includes a body and a doctor blade. The body has a lower surface and an inner surface that intersects the lower surface. The inner surface defines a passageway through the body and is configured to engage a removable pre-filled ink cup to secure the ink cup to the body. The inner surface is configured to direct ink from the ink cup through the passageway toward an ink-receiving surface of a cliché device of the pad printing system. The doctor blade is configured to be coupled with the lower surface of the body and to engage the cliché device. The doctor blade, the inner surface of the body, the ink cup, and a portion of the ink-receiving surface of the cliché device that is bounded by the doctor blade define an ink retaining volume of the body. The ink retaining volume holds at least some of the ink from the ink cup when the ink cup is coupled with the inner surface of the body and the doctor blade engages the ink-receiving surface.

The aforementioned and other features and advantages of the inventive subject matter described herein will become further apparent from the following detailed description of the inventive subject matter, read in conjunction with the accompanying drawings. The detailed description and drawings are merely illustrative of the inventive subject matter rather than limiting.

BRIEF DESCRIPTION OF THE DRAWINGS

The present inventive subject matter will be better understood from reading the following description of non-limiting embodiments, with reference to the attached drawings, wherein below.

DETAILED DESCRIPTION

As used herein, an element or step recited in the singular and proceeded with the word "a" or "an" should be understood as not excluding plural of said elements or steps, unless such exclusion is explicitly stated. Furthermore, references to "one embodiment" of the presently described subject matter are not intended to be interpreted as excluding the existence of additional embodiments that also incorporate the recited features. Moreover, unless explicitly stated to the contrary, embodiments "comprising," "comprises," "including," "includes," "having," or "has" an element or a plurality of elements having a particular property may include additional such elements not having that property.

Figure 1:
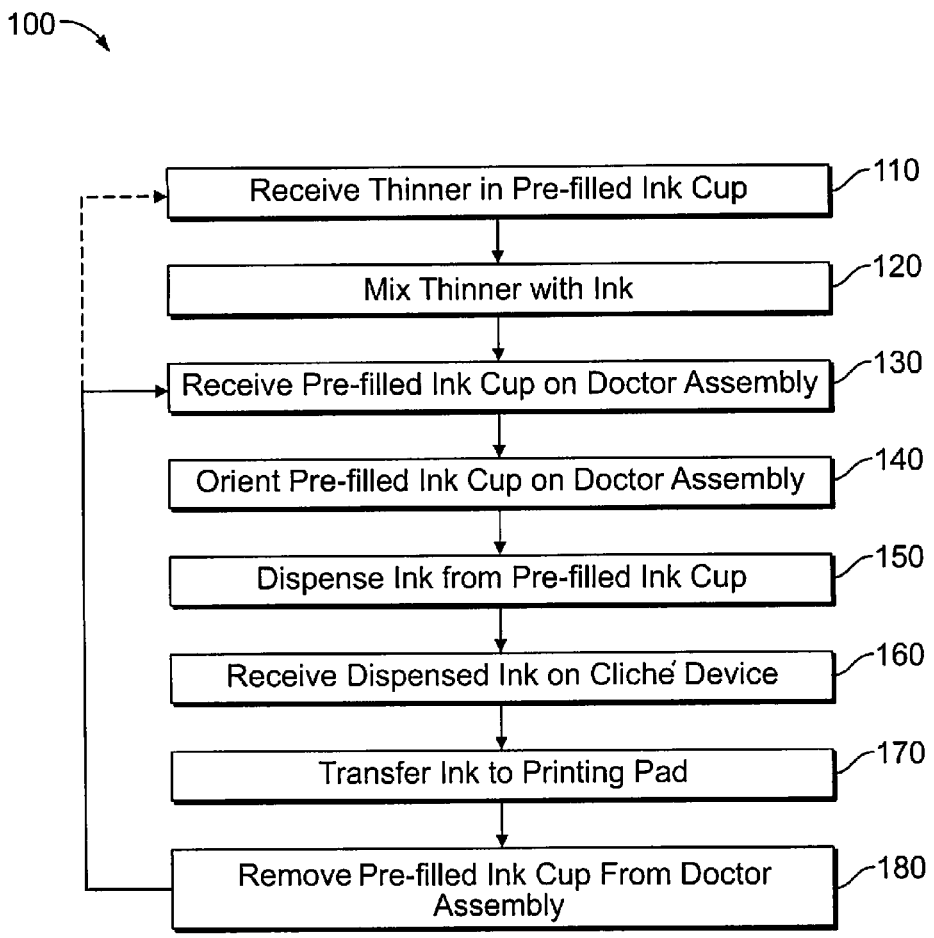
FIG. 1 illustrates a flowchart of one example of a method for pad printing with a removable pre-filled ink cup.

FIG. 1 illustrates a flowchart of one example of a method 100 for pad printing with a removable pre-filled ink cup, in accordance with the invention at 100. At 110, a volume of a thinner is received in a removable pre-filled ink cup. An example removable pre-filled ink cup may be cylindrical in shape and include a volume of ink with an additional space, within the cup, that is reserved for the addition of the thinner. The removable pre-filled ink cup can be manufactured of steel, a rigid plastic, or another material. The material chosen may need to be able to withstand the stresses applied to the cup in a pad printing system, such as contact with a cup stop device that limits lateral movement (e.g., movement of the cup in a direction or plane that is parallel or substantially parallel to an ink-receiving surface of a cliché device). By "substantially parallel," it is meant that the direction or plane of movement of the cup may not be exactly parallel to the ink-receiving surface, but may be within manufacturing tolerances of a pad printing system that includes the cliché device (e.g., within a few degrees).

In one embodiment, at 120, the thinner is mixed with the ink in the removable pre-filled ink cup. The thinner adjusts the ink to a desired viscosity for use in the pad printing system.

Alternatively, in one embodiment, the thinner may be mixed with the ink prior to loading the ink into the cup. For example, the manufacturer, vendor, or other provider of the removable pre-filled ink cup may provide the cup with the ink and thinner pre-loaded into the cup before being received by a user of the cup. The user of the cup may then use the cup in connection with the pad printing system (as described below) without adding thinner or other components to the ink. In another embodiment, the pre-filled ink cup may be filled with the ink and thinner by the manufacturer, vendor, or other provider, and the user of the ink cup may add more or different thinner, ink, or other substances to the cup to change the viscosity, color, adhesion characteristics, or other characteristics of the ink to be used in the pad printing system.

At 130, the removable pre-filled ink cup is received on a doctor assembly of the pad printing system. The doctor assembly holds the ink cup in the pad printing system and is configured to allow the removable pre-filled ink cup to be attached and detached as needed. By providing a removable, pre-filled ink cup to a user of the pad printing system, the user may more easily remove ink cups that are depleted or substantially depleted from ink (e.g., any remaining amount of ink in the depleted ink cup is insufficient to fill the etched recesses on the cliché plate) from the doctor assembly and couple another removable, pre-filled ink cup to the doctor assembly for additional printing. The ink cups may be disposable so that the user can simply swap out depleted ink cups for new or filled ink cups without having to clean out the depleted ink cup before loading more ink into the ink cup.

At 140, the removable pre-filled ink cup is oriented on the doctor assembly. Various devices, assemblies, systems, and the like, for orienting the removable pre-filled ink cup on the doctor assembly can be used. The doctor assembly aligns the removable pre-filled ink cup in the pad printing system.

Once the removable pre-filled ink cup is oriented on the doctor assembly, printing can commence or continue. At 150, the ink is dispensed from the oriented removable pre-filled ink cup and, at 160, the dispensed ink is received onto a cliché device (e.g., the cliché plate) of the pad printing system.

At 170, the dispensed ink on the cliché device is then transferred to a deformable printing pad for application to a print object (e.g., an object on which an image formed by the ink is to be printed).

At 180, the removable pre-filled ink cup is removed from the doctor assembly. For example, after the ink cup is depleted of ink (e.g., the cup is empty), the ink cup may be decoupled from the doctor assembly. In another example, after less than a designated amount of ink remains in the ink cup (e.g., less than an amount of ink that is necessary to form the entire image of the etched cliché device on the object to be printed), the ink cup may be decoupled from the doctor assembly. In another example, after a user of the pad printing system decides to change the ink cup (e.g., to switch colors, to switch printing pads, to switch objects to be printed, to switch cliché devices, and the like), the ink cup is decoupled from the doctor assembly. Upon removal, the removed ink cup may be discarded.

In one embodiment, flow of the method 100 may return to 130, where another removable, pre-filled ink cup is coupled with the doctor assembly, as described above. The method 100 may proceed in a loop-wise manner such that depleted ink cups may be removed from the doctor assembly and replaced with other ink cups (e.g., having more and/or different ink). Excess ink can be cleaned from the doctor assembly and/or cliché device before a replacement removable pre-filled ink cup is oriented on the doctor assembly. Alternatively, the replacement ink cup may be coupled with doctor assembly without cleaning the doctor assembly and/or cliché device.

In another embodiment, flow of the method 100 may return to 110, where thinner is received in a replacement ink cup. For example, instead of the method 100 returning to 130 for replacement of a depleted ink cup, the method 100 may return to 110 where additional and/or different thinner, ink, or other components may be added to a replacement ink cup prior to coupling the replacement ink cup to the doctor assembly.

Figure 2:
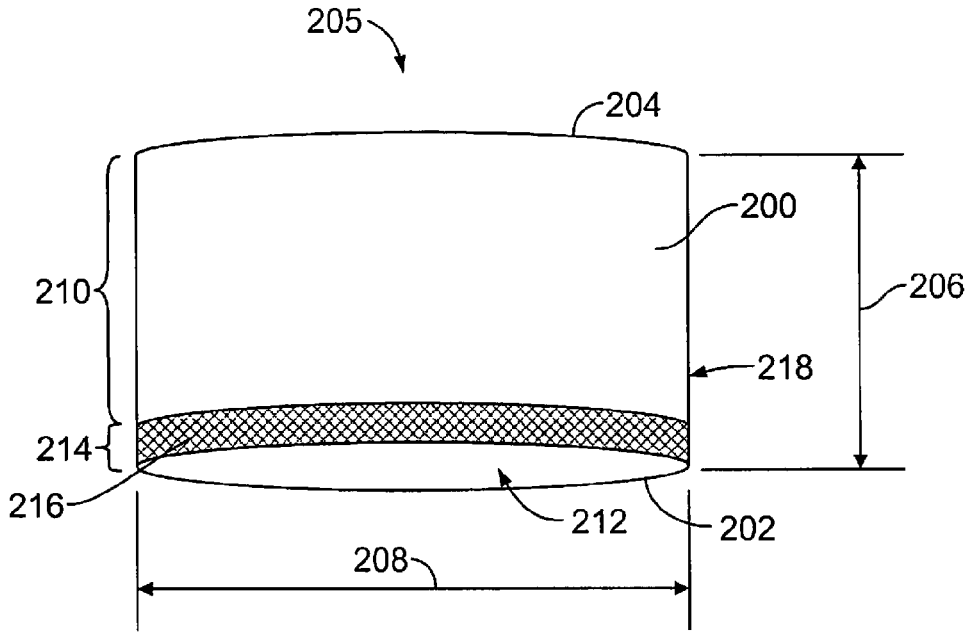
FIG. 2 illustrates a schematic representative of one example of a pre-filled ink cup for a pad printing system.

FIG. 2 illustrates a schematic representation of one example of a pre-filled ink cup 205 for a pad printing system. The pre-filled ink cup 205 is a removable pre-filled ink cup and includes a body 200 that extends between opposite ends that include a closed end 204 and an open or dispensing end 202. In the illustrated embodiment, the body 200 is cylindrical, although other shapes may be used. The body 200 may have a height dimension 206 that is measured from one end 202 or 204 to the other end 204 or 202. The body 200 also may have a width dimension 208. For example, a cylindrical shaped body 200 may have the width dimension 208 that represents the outer diameter of the cylinder formed by the body 200. Alternatively, a differently shaped body 200 may have another width dimension 208.

The body 200 includes an ink retention portion 210 and a coupling portion 214. In the illustrated embodiment, the ink retention portion 210 extends from the closed end 204 of the body 200 to the coupling portion 214 and the coupling portion 214 extends from the ink retention portion 210 to the opposite open or dispensing end 202 of the body 200. Alternatively, the ink retention portion 210 and the coupling portion 214 may be separated by one or more other portions of the body 200.

The ink retention portion 210 can be pre-filled with a quantity of ink and/or thinner (not shown in FIG. 2). The ink is supplied along with the removable pre-filled ink cup 205 and the removable pre-filled ink cup 205 can be disposed once the ink is depleted, as described above. The closed end 204 may be a closed such that the ink retention portion 210 forms a cup that holds the ink within the cup 205 when the closed end 204 is oriented downward and the open or dispensing end 202 is oriented upward (e.g., relative to the direction of force of gravity).

The removable pre-filled ink cup 205 includes an opening 212 at the open or dispensing end 202 for addition of a thinner and/or to permit the flow of ink from the cup 205 and onto the cliché device in the pad printing system. In the illustrated embodiment, the opening 212 extends across the entire width dimension 208 of the open end 202. Alternatively, the opening 212 may extend over only a portion of the width dimension 208 of the open end 202. For example, the diameter of the opening 212 may be smaller than the width dimension 208 of the open end 202.

The coupling portion 214 (alternatively referred to as a doctor assembly orientation portion) is disposed at or substantially adjacent to the opening 212. For example, the coupling portion 214 can extend from the opening 212 or the open end 202 toward the ink retention portion 210. In one example, the coupling portion 214 is a threaded section 216 of an outer surface 218 of the body 200 of the removable pre-filled ink cup 205. The coupling portion 214 enables insertion and removal of the removable pre-filled ink cup 205 in the pad printing system.

The removable pre-filled ink cup 205 can be constructed of a material appropriate for the pad printing system, taking into consideration various factors, such as ease of manufacture, cost of manufacture, compatibility with the ink and associated thinners, opportunity for recycling, weight, structural stability, and the like. In one example, the removable pre-filled ink cup 205 is constructed of a metal, such as steel or aluminum. In another example, the removable pre-filled ink cup 205 is constructed of a plastic, such as one or more thermoset polymers.

Figure 3:
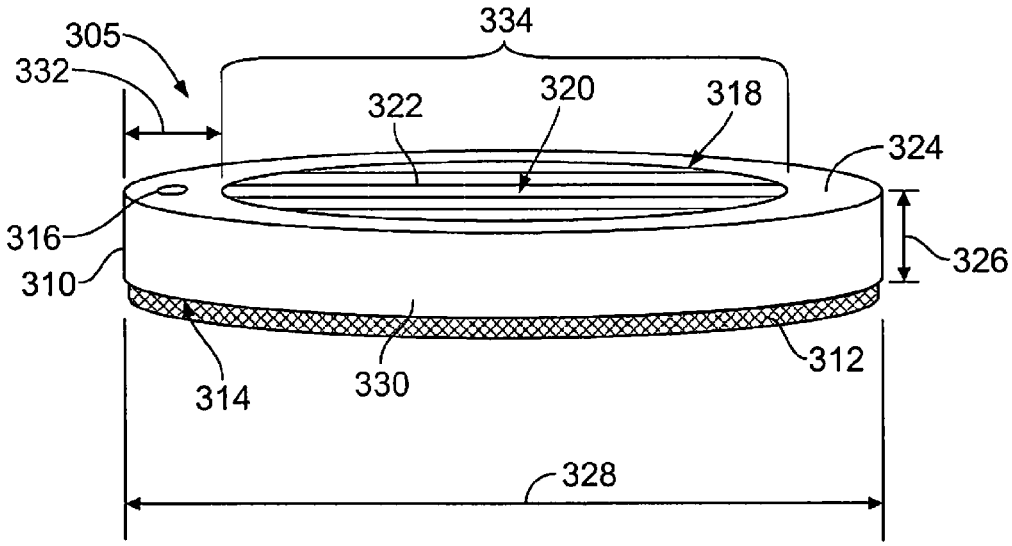
FIG. 3 illustrates a schematic representative of one example of a doctor assembly for a pad printing system.

FIG. 3 illustrates a schematic representation of one example of a doctor assembly 305 for a pad printing system. The doctor assembly 305 includes an orientation unit or body 310. The body 310 is shown in the shape of a circular ring, but alternatively may have one or more other shapes. The body 310 extends between a lower end or surface 314 and an opposite upper end or surface 324 (also referred to as a coupling surface). The body 310 has a height dimension 326 that is measured from one end 314 or 324 to the other end 324 or 314.

The body 310 also extends between an inner surface 320 and an opposite outer surface 330. In one embodiment, the outer surface 330 defines an outer perimeter of the body 310 and the inner surface 320 defines an inner perimeter of the body 310. A thickness dimension 332 of the body 310 may be measured from one surface 320 or 330 to the other surface 330 or 320. The body 310 also may have a width dimension 328. For example, a ring shaped body 310 may have the width dimension 328 that represents the outer diameter of the ring formed by the body 310. Alternatively, a differently shaped body 310 may have another width dimension 328. The body 310 shown in FIG. 3 extends around and defines a passageway 334 through the body 310 from one surface 320 or 330 to the opposite surface 330 or 320.

A doctor blade 312 is coupled to the body 310 of the doctor assembly 305. In the illustrated embodiment, the doctor blade 312 is an annular blade that is joined to the lower end or surface 314 of the body 310. Alternatively, the doctor blade 312 may be coupled to the body 310 between the upper end or surface 324 and the lower end or surface 314. For example, the doctor blade 312 may be joined to the body 310 along at least a portion, or all, of the outer perimeter of the ring formed by the body 310. The upper end or surface 324 includes at least one connection point 316 for connecting the doctor assembly 305 to the pad printing system. In another embodiment, the removable pre-filled ink cup 205 includes the doctor blade 312 affixed adjacent or proximate to the opening 212 at the end 202 of the cup 205 (shown in FIG. 2). In this embodiment, the removable pre-filled ink cup 205, with the doctor blade 312, comprises or forms the doctor assembly 305. For example, the doctor assembly 305 may not be used or provided with the cup 205 and the blade coupled to the cup 205 replacing the doctor assembly 305.

The doctor assembly 305 includes a cup receiving portion 318, such as threads 322 on at least a portion of the inner surface 320 of the body 310. The receiving portion 318 is configured for receiving the removable pre-filled ink cup 205 shown in FIG. 2 on the doctor assembly 305. The removable pre-filled ink cup 205 may be coupled and oriented with the doctor assembly 305 by engaging the coupling portion 214 (e.g., the threaded section 216 of the outer surface 218 of the body 200 of the removable pre-filled ink cup 205, as shown in FIG. 2) with the cup receiving portion 318 of the doctor assembly 305 (e.g., the threads 322 on the inner surface 320). The coupling portion 214 enables insertion and removal of the removable pre-filled ink cup 205 from the doctor assembly 305 in the pad printing system.

In one embodiment, the coupling portion 214 of the removable pre-filled ink cup 205 and the receiving portion 318 of the doctor assembly 305 include corresponding interlocking components for orienting the removable pre-filled ink cup 205 on the doctor assembly 305. For example, the cup 205 may be connected to the doctor assembly 305 by inserting the open or dispensing end 202 (shown in FIG. 2) of the cup 205 into the passageway 334 of the doctor assembly 305 through the upper surface 324. In one embodiment, the cup 205 and/or the doctor assembly 305 may be rotated relative to the other such that the threaded section 216 (shown in FIG. 2) of the cup 205 engages and secures the cup 205 to the threads 322 of the cup receiving portion 318 of the doctor assembly 305. When the cup 205 is to be removed and replaced, the cup 205 and/or doctor assembly 305 may be rotated relative to the other in an opposite direction to disconnect the threaded section 216 of the cup 205 from the threads 322 of the cup receiving portion 318 of the doctor assembly 305. In another example, corresponding clamping portions are included for orienting the removable pre-filled ink cup 205 on the doctor assembly 305. Alternatively, a device, assembly, or system that does not use threads may be used to connect the cup 205 to the doctor assembly 305. For example, one or more keying features, pins-and-slots, tongues-and-grooves, or other components may be used to connect the cup 205 to the doctor assembly 305.

Figure 4:
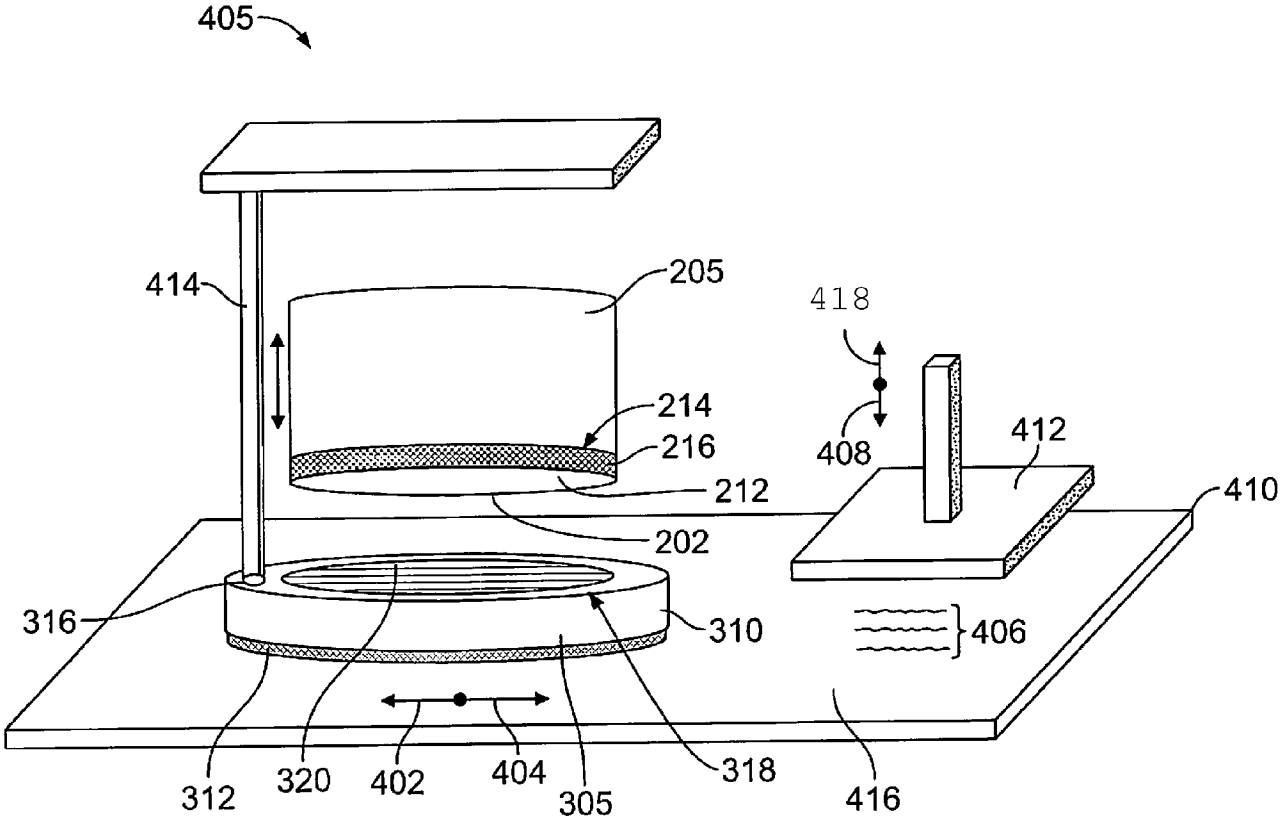
FIG. 4 illustrates a schematic representative of one example of a system for pad printing with removable pre-filled ink cup.

FIG. 4 illustrates a schematic representation of one example of a pad printing system 405 for pad printing with pre-filled ink cups. The pad printing system 405 includes a cliché device 410, a printing pad 412, and a mounting unit 414. The removable pre-filled ink cup 205 is received by the receiving portion 318 of doctor assembly 305 in an inverted position. For example, the dispensing or open end 202 of the cup 205 may be inserted into the doctor assembly 305 so that the ink in the cup 205 flows out of the cup 205 (e.g., the ink retention portion 210 shown in FIG. 2) and into the passageway 334 (shown in FIG. 3) of the doctor assembly 305. In one embodiment, the opening 212 at the end 202 of the cup 205 may be substantially adjacent to the cliché device 410, such as by being no more than 0.3 inches or 7.62 millimeters from the cliché device 410, when the cup 205 is coupled with the doctor assembly 305. Alternatively, the opening 212 at the end 202 of the cup 205 may be a smaller or larger distance from the cliché device 410.

The coupling portion 214 of the removable pre-filled ink cup 205 may correspond to the receiving portion 318 on the doctor assembly 305 so that the two corresponding portions are aligned and the threaded portion 216 of the removable pre-filled ink cup 205 engages the threads 322 on the inside surface 320 of the body 310 of the doctor assembly 305. The engagement between the coupling portion 214 and the receiving portion 318 can provide orientation of the removable pre-filled ink cup 205 on the doctor assembly 305 within the pad printing system 405. For example, the engagement between the portions 214, 318 can cause the opening 212 at the end 202 of the cup 205 to be a designated distance, or no more than a designated distance, from the cliché device 410. Controlling or limiting this distance can allow for the system 405 to control how much ink is dispensed and/or how rapidly ink is dispensed from the cup 205 onto an ink-receiving surface 416 of the cliché device 410.

In one embodiment, when the cup 205 is connected with the doctor assembly 305, the ink in the cup 205 fills or at least partially fills a volume that is defined (e.g., bounded) by the inner surface 320 (shown in FIG. 3) and/or the blade 312 of the doctor assembly 305, the cup 205, and the portion of the cliché device 410 disposed within (e.g., bounded by) the perimeter defined by an interface between the blade 312 and the cliché device 410. During operation, the blade 312 may keep the ink from the cup 205 within this volume except for the ink that is disposed within etched image-forming recesses 406 of the cliché device 410.

The mounting unit 414 includes a structure that is suitable for mounting the doctor assembly 305, with the removable pre-filled ink cup 205 oriented thereon, in the pad printing system 405. The mounting unit 414 can be integrated with a push rod, a suspension system, a hold down unit, or other structure within the pad printing system 405 to hold down the doctor assembly 305 onto the cliché device 410 such that the blade 312 of the doctor assembly 305 engages the cliché device 410.

In operation, ink flows by gravity from the removable pre-filled ink cup 205 onto cliché device 410 through the passageway 334 (shown in FIG. 3) of the doctor assembly 305. The doctor blade 312 can provide a seal between the doctor assembly 305 and the cliché device 410. The doctor blade 312 wipes or scrapes excess ink from cliché device 410 (e.g., ink that is not disposed within the image-forming recesses 406 on the cliché device 410) as the doctor assembly 305 and/or the cliché device 410 are translated relative to the other along opposite lateral directions 402, 404 along the cliché device 410. The ink remaining on the cliché device 410 (e.g., within the image-forming recesses 406 in the cliché device 410) after the doctor blade 312 moves over the image-forming recesses 406 is transferred to the printing pad 412 by pressing the printing pad 412 against the inked cliché device 410 along a downward direction 408 at or around the image-forming recesses 406. Ink in the image-forming recesses 406 is transferred to the printing pad 412. The printing pad 412 with the transferred ink is separated from the cliché device 410 along an upward or separation direction 418 for subsequent transfer of the ink to a print object. For example, the print object may be moved below the printing pad 412 or the printing pad 412 may be moved to a position over the print object, and the pad 412 and/or object may move toward the other to apply the transferred ink to the print object.

Figure 6:
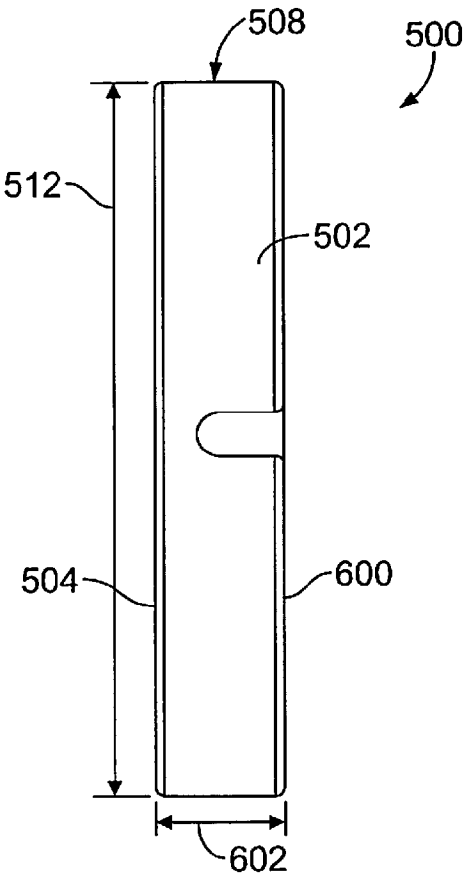
FIG. 6 is a side view of the doctor assembly shown in FIG. 5.
Figure 5:
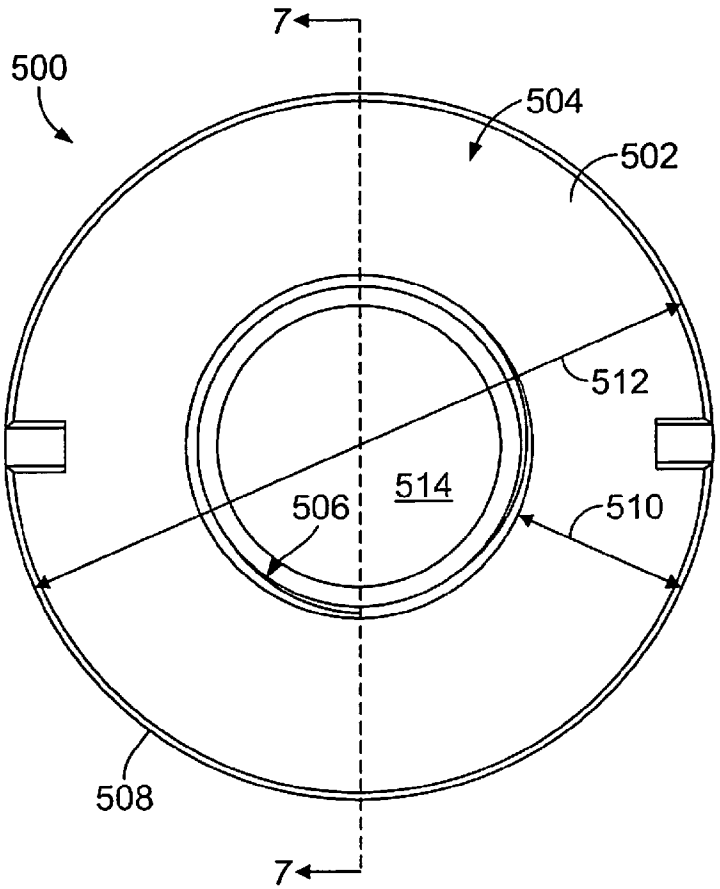
FIG. 5 is a top view of another example of a doctor assembly.

FIG. 5 is a top view of another example of a doctor assembly 500. FIG. 6 is a side view of the doctor assembly 500 shown in FIG. 5. The doctor assembly 500 may be used in connection with the pad printing system 405 shown in FIG. 4. For example, the doctor assembly 305 (shown in FIG. 3) may represent the doctor assembly 500. As described above, the doctor assembly 500 may have a body 502. The body 502 may be a circular shaped ring, or may have another shape, such as a polygon shaped ring or other shape. The body 502 can be formed from a single component. For example, instead of forming the body 502 multiple parts that are joined together, the body 502 may be formed as a single, unitary body. In another embodiment, the body 502 can be formed from two or more parts. The body 502 extends along a first direction (e.g., a vertical direction with respect to the cliché device 410 shown in FIG. 4) from a lower end or surface 600 (shown in FIG. 6) to an opposite upper end or surface 504. The ends or surfaces 504, 600 may be separated by a height dimension 602 along the first direction.

The body 502 also extends between an inner surface 506 (shown in FIG. 5) and an opposite outer surface 508. In one embodiment, the outer surface 508 defines an outer perimeter of the body 502 and the inner surface 506 defines an inner perimeter of the body 502. A thickness dimension 510 (shown in FIG. 5) of the body 502 may be measured from one surface 506 or 508 to the other surface 508 or 506. The body 502 also may have a width dimension 512. For example, a ring shaped body 502 may have a width dimension 512 that represents the outer diameter of the ring formed by the body 502. The body 502 extends around and defines a passageway 514 (shown in FIG. 5) through the body 502 from one surface 504 or 600 to the opposite surface 600 or 504.

Figure 7:
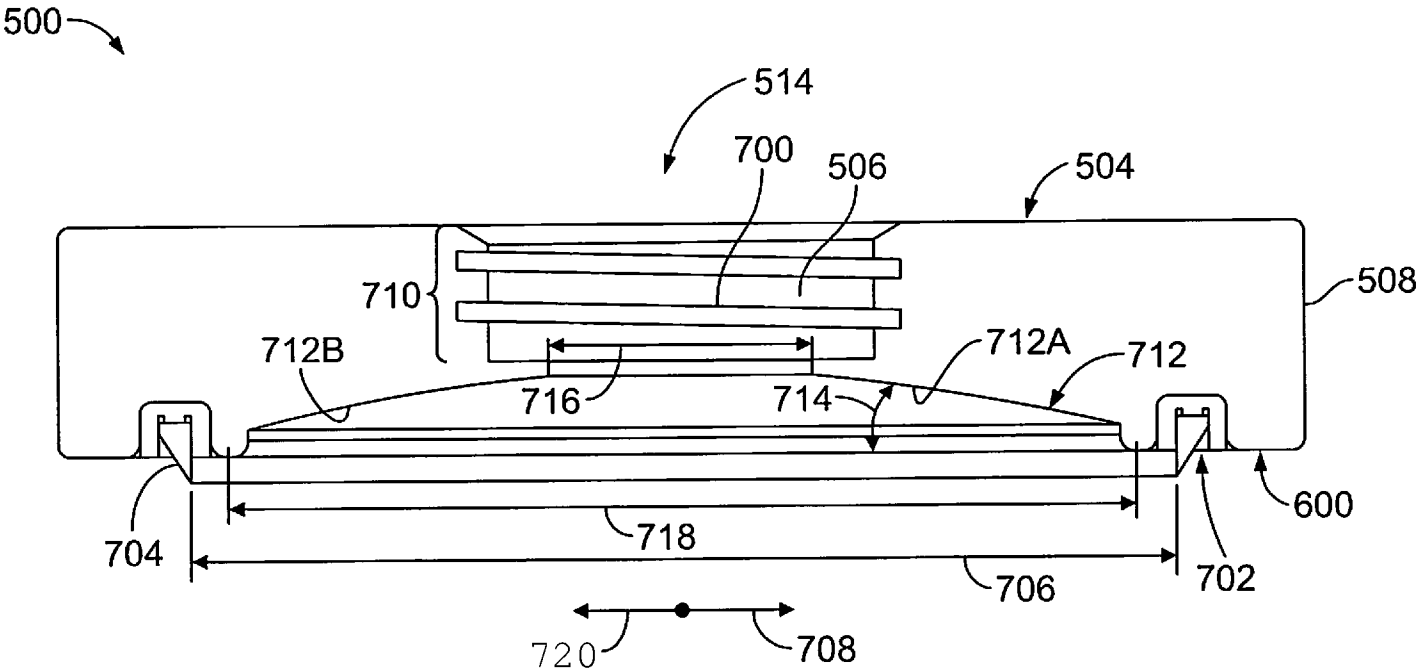
FIG. 7 is a cross-sectional view of one example of the doctor assembly along line 7-7 shown in FIG. 5.

FIG. 7 is a cross-sectional view of one example of the doctor assembly 500 along line 7-7 shown in FIG. 5. As described above, the inner surface 506 of the doctor assembly 500 in the passageway 514 can include threads 700 to couple with a corresponding or complementary threaded portion 216 (shown in FIG. 2) of the cup 205 (shown in FIG. 2). The open end 202 (shown in FIG. 2) of the cup 205 is loaded into the passageway 514 through the upper surface 504 of the doctor assembly 500 so that the threaded portion 216 of the cup 205 can engage the threads 700 of the doctor assembly 500. The engagement between the threaded portion 216 of the cup 205 and the threads 700 of the doctor assembly 500 may seal the cup 205 to the doctor assembly 500. For example, the engagement between the cup 205 and the doctor assembly 500 may cause the ink inside the cup 205 to be dispensed out of the cup and into the passageway 514 of the doctor assembly 500.

In the illustrated embodiment, the lower surface 600 of the doctor assembly 500 faces the ink-receiving surface 416 (shown in FIG. 4) of the cliché device 410 (shown in FIG. 4) and includes a channel 702 that extends into the lower surface 600. The channel 702 is shaped to receive a doctor blade 704, such as an annular doctor blade 704. The channel 702 may extend around a perimeter of the passageway 514 at the lower surface 600 of the doctor assembly 500 so that the doctor blade 704 at least partially encircles the passageway 514 at the lower surface 600. Alternatively, the channel 702 and/or doctor blade 704 may extend around only a portion (and less than all) of the perimeter of the passageway 514 at the lower surface 600.

When the cup 205 (shown in FIG. 2) is coupled with the doctor assembly 500 and the doctor blade 704 engages the cliché device 410 (shown in FIG. 4), an ink retaining volume may be defined within the passageway 514 of the doctor assembly 500. The ink retaining volume represents a chamber or volume within the doctor assembly 500 in which ink from the cup 205 is held as the doctor assembly 500 and/or cliché device 410 move relative to the other, as described above. In the illustrated embodiment, the ink retaining volume is bounded by the doctor blade 704, the portion of the cliché device 410 that is disposed within the doctor blade 704 when the doctor blade 704 engages the cliché device 410, the interior surface 506 of the doctor assembly 500, and the cup 205 when the cup 205 is secured to the doctor assembly 500.

As shown in the illustrated embodiment, the doctor blade 704 is laterally spaced apart from the passageway 514 of the doctor assembly 500. For example, the doctor blade 704 may be located outside of (e.g., at a larger diameter dimension) than the inner surface 506 of the doctor assembly 500 that defines the passageway 514. Additionally, the doctor blade 704 shown in FIG. 7 is laterally spaced apart from and located outside of the ink retaining volume of the doctor assembly 500. The doctor blade 704 may define an outer boundary of the ink retaining volume. The doctor blade 704 is laterally disposed outside of the coupling portion 216 (shown in FIG. 2) of the cup 205 (shown in FIG. 2) when the cup 205 is joined with the doctor assembly 500. For example, the doctor blade 704 may have a diameter or width dimension 706 that is larger than the diameter dimension 208 (shown in FIG. 2) of the cup 205. As shown in the embodiment of FIG. 7, the inner surface 506 of the doctor assembly 500 that includes the threads 700 is smaller (e.g., has a smaller diameter) than the diameter of the doctor blade 704 such that the doctor blade 704 is laterally disposed outside of the inner surface 506 of the doctor assembly 500 and the coupling portion 216 of the cup 205.

The inner surface 506 of the doctor assembly 500 can include an angled interior wall 712. In the illustrated embodiment, the interior wall 712 extends from a coupling section 710 of the inner surface 506 that includes the threads 700 to the lower surface 600 of the doctor assembly 500. The interior wall 712 may be formed as a portion of a cone that extends from the section of the inner surface 506 that includes the threads 700 to the lower surface 600 of the doctor assembly 500. For example, at an intersection between the coupling section 710 of the inner surface 506, the cone formed by the interior wall 712 may have a first diameter dimension 716. At an intersection between the interior wall 712 and the lower surface 600, the interior wall 712 may have a larger, second diameter dimension 718. Alternatively, the interior wall 712 may be formed in another shape. For example, the interior wall 712 may be formed as a pyramid or other shape having angled walls.

As shown in FIG. 7, the interior wall 712 intersects the lower surface 600 such that the interior wall 712 is disposed at an angle 714 with respect to the lower surface 600. For example, the interior wall 712 may be oriented at the angle 714 with respect to a two dimensional plane in which the lower surface 600 is disposed. The wall 712 can be oriented at an acute angle with respect to the lower surface 600. Alternatively, the wall 712 may be oriented at an obtuse angle or at a perpendicular angle.

In one embodiment, the interior wall 712 may be provided in order to cause the ink in the ink retaining volume of the doctor assembly 500 to be spread out over the image-forming recesses 406 (shown in FIG. 4) of the cliché device 410 (shown in FIG. 4) when the doctor assembly 500 moves over the etched recesses 406.

As the doctor assembly 500 and/or cliché device 410 (shown in FIG. 4) repeatedly move relative to the other in order to deposit the ink into the etched recesses 406 (shown in FIG. 4) of the cliché device 410, the ink in the ink retaining volume can decrease. As the amount of ink in the ink retaining volume decreases, additional ink from the cup 205 (shown in FIG. 2) may flow into the ink retaining volume. Eventually, enough ink may be dispensed and printed onto the print object that the ink may not completely fill the ink retaining volume between the cliché device 410 and the dispensing end 202 (shown in FIG. 2) of the cup 205. Due to the back-and-forth movement of the doctor assembly 500 over the cliché device 410, the ink in the ink retaining volume of the doctor assembly 500 may laterally flow back-and-forth. For example, as the doctor assembly 500 moves in a first lateral direction 708 (e.g., along or parallel to the ink-receiving surface 416 of the cliché device 410), some of the ink may be pushed up against the portion of the interior wall 712 labeled 712B in FIG. 7. Conversely, when the doctor assembly 500 moves in an opposite second lateral direction 720, some of the ink may be pushed up against the portion of the interior wall 712 labeled 712A in FIG. 7.

When the lateral movement of the doctor assembly 500 slows or stops, the ink that is pushed by the interior wall portion 712B may flow (e.g., as a wave) in the ink retaining volume toward an opposite portion of the interior wall 712 that is labeled 712A in FIG. 7. The doctor assembly 500 may stop and be positioned over the image-forming recesses 406 (shown in FIG. 4) for a sufficient time period that the pushed ink moves over and covers (e.g., extends over all of the recesses 406) that are beneath the ink retaining volume of the doctor assembly 500. For example, the wave of ink that is pushed or created by movement of the interior wall portion 712B may have sufficient energy to cause the ink to fill all of the recesses 406 that are located within a boundary defined by an interface between the doctor blade 704 and the ink-receiving surface 416 of the cliché device 410. As a result, the ink may fill the recesses 406 such that the entire image associated with the recesses 406 can be formed on the pad 412 (shown in FIG. 4) and then onto the print object.

Figure 9:
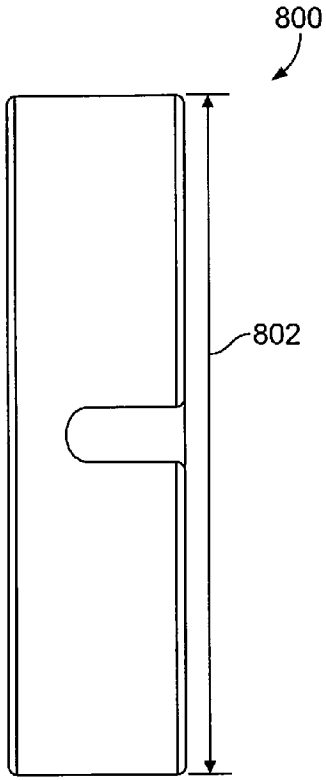
FIG. 9 is a side view of the doctor assembly shown in FIG. 8.
Figure 8:
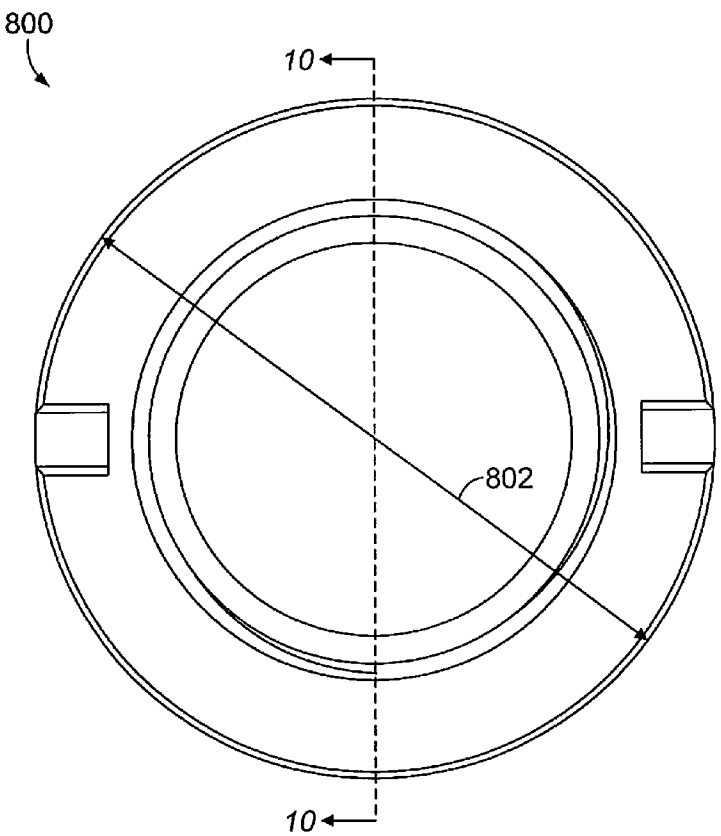
FIG. 8 is a top view of another example of a doctor assembly.

FIG. 8 is a top view of another example of a doctor assembly 800. FIG. 9 is a side view of the doctor assembly 800 shown in FIG. 8. The doctor assembly 800 may be similar to the doctor assembly 500 shown in FIG. 5. For example, the doctor assembly 800 may be used in connection with the pad printing system 405 shown in FIG. 4. For example, the doctor assembly 305 (shown in FIG. 3) may represent the doctor assembly 800. The doctor assembly 800 may have similar features and components as the doctor assembly 500 described above, such as a ring-shaped body, opposite upper and lower ends or surfaces, opposite inner and outer surfaces, and the like.

One difference between the doctor assembly 800 and the doctor assembly 500 (shown in FIG. 5) is that the doctor assembly 800 may have a smaller width dimension 802 than the width dimension 512 (shown in FIG. 5) of the doctor assembly 500. For example, in one embodiment, the width dimension 802 of the doctor assembly 800 may be 70% or smaller than the width dimension 512 of the doctor assembly 500. Alternatively, the width dimension 802 may be a larger or smaller percentage or fraction of the width dimension 512 of the doctor assembly 500. In one embodiment, the width dimension 802 of the doctor assembly 800 is 4.330 inches or 109.98 millimeters and the width dimension 512 of the doctor assembly 500 is 2.992 inches or 76.00 millimeters. In another embodiment, the width dimension 802 and/or the width dimension 512 may have another size.

Figure 10:
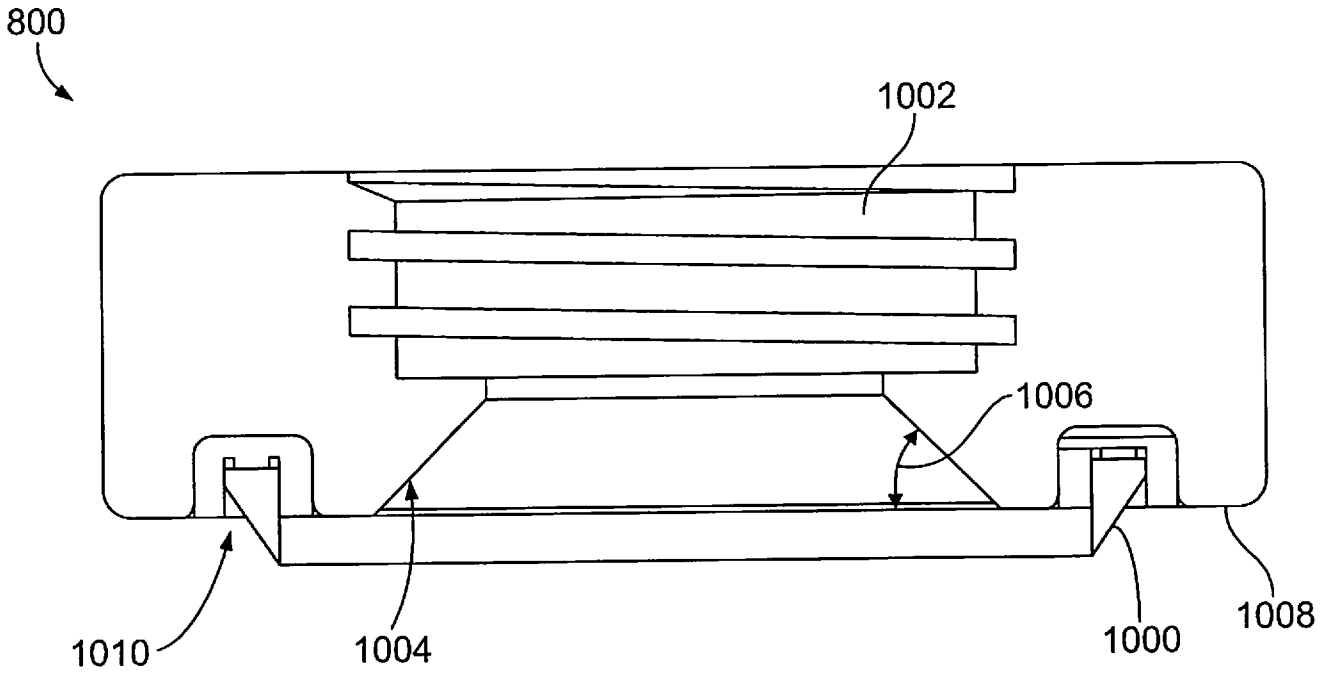
FIG. 10 is a cross-sectional view of one example of the doctor assembly along line 10-10 shown in FIG. 8.

FIG. 10 is a cross-sectional view of one example of the doctor assembly 800 along line 10-10 shown in FIG. 8. As shown in the illustrated embodiment, the doctor assembly 800 may include a doctor blade 1000 that is similar to the doctor blade 704 (shown in FIG. 7). One difference between the doctor blade 1000 and the doctor blade 704 may be that the doctor blade 1000 may be smaller (e.g., have a smaller diameter) than the doctor blade 704.

Similar to the doctor assembly 500 (shown in FIG. 5), an inner surface 1002 of the doctor assembly 800 can include an interior wall 1004 that is similar to the interior wall 712 (shown in FIG. 7) of the doctor assembly 500. One difference between the interior walls 712, 1004 may be the angles at which the interior walls 712, 1004 are disposed. For example, the interior wall 1004 may be oriented at a larger angle 1006 from a lower surface 1008 of the doctor assembly 800 relative to the angle 714 (shown in FIG. 7) of the interior wall 712 in the doctor assembly 500. In the illustrated embodiments, the angle 1006 of the interior wall 1004 is at least four times larger than the angle 714 of the interior wall 712. For example, the angle 1006 may be 56 degrees while the angle 714 may be 13 degrees. Alternatively, one or more of the angles 714, 1006 and/or the ratios of the angles 714, 1006 may be different or have another value.

In one embodiment, the interior walls 712, 1004 of the differently sized doctor assemblies 500, 800 may be oriented at different angles 714, 1006 so that the ink in the ink retaining volume of the doctor assemblies 500, 800 is moved to cover the recesses 406 (shown in FIG. 4) on the cliché device 410 (shown in FIG. 4) when the recesses 406 are disposed within the doctor blades 704, 1000 (e.g., in an area of the ink-receiving surface 416 of the cliché device 410 that is bounded by an interface between the doctor blade 704, 1000 and the ink-receiving surface 416 of the cliché device 410). For example, the angle 1006 of the wall 1004 in the smaller doctor assembly 800 (e.g., the doctor assembly having a smaller diameter or width dimension) may be a larger angle or have a greater pitch than the angle 714 of the wall 712 in the larger doctor assembly 500 (e.g., the doctor assembly having a larger diameter or width dimension). Decreasing the angle of the wall 1004 in the smaller doctor assembly 800 may cause the ink in the ink retaining portion to not flow or move (e.g., as a wave) within the ink retaining portion to cover an entire group of recesses 406 that correspond to an image when the group of recesses 406 are disposed within (e.g., bounded by) the doctor blade 1000. Such a decreased angle may cause the wall 1004 to not transfer sufficient energy to the wave of ink that is formed by the doctor assembly 800 moving laterally relative to the cliché device 410 so that at least some of the recesses 406 do not receive sufficient ink to transfer the image represented by the recesses to the printing pad 412 (shown in FIG. 4).

Similarly, increasing the angle of the wall 712 in the larger doctor assembly 500 may cause the ink in the ink retaining portion to not flow or move within the ink retaining portion to cover an entire group of recesses 406 that correspond to the image when the group of recesses 406 are disposed within the doctor blade 704. Increasing the angle may cause the wall 712 to not transfer sufficient energy to the wave of ink that is formed by the doctor assembly 500 moving laterally relative to the cliché device 410 so that at least some of the recesses 406 do not receive sufficient ink to transfer the image represented by the recesses to the printing pad 412 (shown in FIG. 4).

The angle 714, 1006 of the interior walls 712, 1004 in the doctor assemblies 500, 800 may be based on the diameters or width dimensions of the doctor blades 704, 1000. For example, the angle 714, 1006 may be a function of the diameters or width dimensions of the doctor blades 704, 1000. In one embodiment, the angle 714, 1006 may be inversely related to the diameters or width dimensions of the doctor blades 704, 1000. For example, as the diameter or width dimension of a doctor blade decreases (e.g., the doctor blade 1000 relative to the doctor blade 704), the angle 714, 1006 of the walls 712, 1004 may increase to ensure that the ink in the ink retaining volume of the doctor assembly 500, 800 covers the recesses 406 (shown in FIG. 4). Conversely, as the diameter or width dimension of a doctor blade increases (e.g., the doctor blade 704 relative to the doctor blade 1000), the angle 714, 1006 of the walls 712, 1004 may decrease. In the embodiments shown in FIGS. 7 and 10, the doctor blades 704, 1000 are disposed in the channels 702, 1010 of the doctor assemblies 500, 800. As a result, in one embodiment, the angle 714, 1006 of the walls 712, 1004 may change based on the location and/or size of the channels 702, 1010. For example, as the channels 702, 1010 are disposed farther from the inner surfaces 506, 1002 of the doctor assemblies 500, 800 that engage the cup 205 (e.g., the threads in the passageways of the doctor assemblies 500, 800), the angle 714, 1006 of the walls 712, 1004 may decrease.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While relative dimensions described herein are intended to define the parameters of the inventive subject matter, they are by no means limiting and are example embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A pad printing system comprising:

first and second doctor assemblies each including a body and a doctor blade, the bodies each having an outer surface and an opposite inner surface that defines a passageway through the bodies, the inner surfaces configured to engage removable pre-filled ink cups to secure the ink cups to the bodies, the inner surfaces configured to direct ink from the ink cups through the passageways toward an ink-receiving surface of a cliché device, the doctor blades each configured to be coupled with the corresponding bodies of the first and second doctor assemblies and to engage the cliché device, the doctor blades configured to wipe at least some of the ink along the cliché device as at least one of the bodies or the cliché device laterally moves relative to another of the at least one of the bodies or the cliché device, wherein the doctor blades are configured to be coupled with the bodies such that the doctor blades are laterally spaced apart from the inner surfaces of the bodies, wherein each of the bodies of the first and second doctor assemblies includes a lower surface that faces the ink-receiving surface of the cliché device when the doctor blades engage the ink-receiving surface, and the inner surfaces of the bodies include interior walls that are oriented at acute angles with respect to the lower surfaces of the bodies, wherein the body of the first doctor assembly is larger than the body of the second doctor assembly and the acute angle at which the interior wall is oriented with respect to the lower surface of the first doctor assembly is smaller than the acute angle at which the interior wall is oriented with respect to the lower surface of the second doctor assembly.

2. The pad printing system of claim 1, wherein the doctor blades are configured to be coupled with the bodies such that the doctor blades are disposed outside of the inner surfaces of the bodies.

3. The pad printing system of claim 1, wherein the lower surfaces of the bodies are configured to be coupled with the doctor blades so that the lower surfaces face the cliché device when the doctor blades engage the ink-receiving surface of the cliché device.

4. The pad printing system of claim 1, wherein the inner surfaces of the bodies are configured to decouple from the removable pre-filled ink cups so that another replacement pre-filled ink cup can be secured to the inner surfaces of the bodies.

5. The pad printing system of claim 1, wherein the angles at which the interior walls of the bodies are oriented with respect to the lower surfaces of the bodies are based on a location of the doctor blades on the bodies.

6. The pad printing system of claim 1, wherein the angles at which the interior walls of the bodies are oriented with respect to the lower surfaces of the bodies are inversely related to diameter dimensions of the doctor blades.

7. The pad printing system of claim 1, wherein the acute angles at which the interior walls of the bodies of the first and second doctor assemblies are oriented with respect to the lower surfaces of the bodies are inversely related to outside diameter dimensions of the bodies of the first and second doctor assemblies.

8. A pad printing system comprising first and second doctor assemblies, each of the doctor assemblies having a body that includes:

an inner surface configured to engage a removable pre-filled ink cup to secure the ink cup, the inner surface including an interior wall and defining a passageway that directs ink from the ink cup toward an ink-receiving surface of a cliché device; and a lower surface that intersects the inner surface, the lower surface configured to couple with a doctor blade that engages the ink-receiving surface of the cliché device and wipes at least some of the ink from the ink cup along the ink-receiving surface of the cliché device as the doctor assembly laterally moves along the ink-receiving surface of the cliché device, wherein the interior walls of the inner surfaces of the bodies of the first and second doctor assemblies are oriented at acute angles with respect to the lower surfaces of the respective bodies, wherein an outside diameter dimension of the body of the first doctor assembly is larger than an outside diameter dimension of the body of the second doctor assembly and the acute angle at which the interior wall is oriented with respect to the lower surface of the first doctor assembly is smaller than the acute angle at which the interior wall is oriented with respect to the lower surface of the second doctor assembly.

9. The pad printing system of claim 8, wherein the angles at which the interior walls of the bodies are oriented with respect to the lower surfaces of the bodies are based on locations of the doctor blades on the lower surfaces.

10. The pad printing system of claim 8, wherein the angles at which the interior walls of the bodies are oriented with respect to the lower surfaces of the bodies are inversely related to diameter dimensions of the doctor blades when the doctor blades are coupled to the respective lower surfaces.

11. The pad printing system of claim 8, wherein each of the lower surfaces of the bodies includes a channel configured to receive the respective doctor blade, the channels positioned on the lower surfaces of the bodies such that the doctor blades are laterally spaced apart from the inner surfaces of the bodies when the doctor blades are received in the channels.

12. The pad printing system of claim 11, wherein the channels in the bodies are located on the lower surfaces of the bodies such that the doctor blades are disposed outside of the inner surfaces of the bodies when the doctor blades are received in the channels.

13. The pad printing system of claim 8, wherein the inner surfaces of the bodies are configured to decouple from the removable pre-filled ink cups so that another replacement pre-filled ink cup can be secured to the inner surfaces.

14. The pad printing system of claim 8, wherein the acute angles at which the interior walls of the bodies of the first and second doctor assemblies are oriented with respect to the lower surfaces of the bodies are inversely related to the outside diameter dimensions of the bodies.

15. A pad printing system comprising:

plural doctor assemblies each including a body and a doctor assembly, each of the bodies of the doctor assemblies having a lower surface and an inner surface that intersects the lower surface, the inner surfaces defining passageways through the bodies and configured to engage removable pre-filled ink cups to secure the ink cups to the bodies, the inner surfaces configured to direct ink from the ink cups through the passageways toward an ink-receiving surface of a cliché device the doctor blades configured to be coupled with the lower surfaces of the bodies and to engage the cliché device, wherein the doctor blades, the inner surfaces of the bodies, the ink cups, and portions of the ink-receiving surface of the cliché device that are bounded by the doctor blades define ink retaining volumes of the bodies that hold at least some of the ink from the ink cups when the ink cups are coupled with the inner surfaces of the bodies and the doctor blades engage the ink-receiving surface, wherein the bodies of the doctor assemblies have different outside diameters and the inner surfaces of the bodies of the doctor assemblies are oriented at different acute angles with respect to the lower surfaces of the bodies, and wherein the acute angles are inversely related to the outside diameters.

16. The pad printing system of claim 15, wherein the doctor blades are configured to be coupled with the lower surfaces of the bodies of the doctor assemblies such that the doctor blades are laterally spaced apart from the inner surfaces of the bodies.

17. The pad printing system of claim 15, wherein the doctor blades are configured to be coupled with the lower surfaces of the bodies of the doctor assemblies such that the doctor blades are disposed outside of the inner surfaces of the bodies.

18. The pad printing system of claim 15, wherein the inner surfaces of the bodies of the doctor assemblies are configured to decouple from the removable pre-filled ink cups so that another replacement pre-filled ink cup can be secured to the inner surfaces of the bodies.

19. The pad printing system of claim 14, wherein the inner surfaces of the bodies of the doctor assemblies include an interior wall that is oriented at an acute angle with respect to the lower surface of the body.

* * * * *